United States Patent [19]

Schmid

[11] 4,207,998

[45] Jun. 17, 1980

[54] VACUUM ROLLER

[75] Inventor: Walter Schmid, Stadel, Switzerland

[73] Assignee: Bachofen & Meier, Maschinenfabrik, Bulach, Switzerland

[21] Appl. No.: 952,225

[22] Filed: Oct. 17, 1978

Related U.S. Application Data

[63] Continuation-in-part of Ser. No. 797,643, May 16, 1977, abandoned.

[51] Int. Cl.[2] ..... B65H 17/28

[52] U.S. Cl. ..... 226/95; 226/193; 271/196; 29/121.1

[58] Field of Search ..... 226/7, 95, 97, 190, 226/193; 271/196; 29/121.1

[56] References Cited

U.S. PATENT DOCUMENTS

| | | | |
|---|---|---|---|
| 3,122,295 | 2/1964 | Davison | 226/193 X |
| 4,029,249 | 6/1977 | Nagel | 226/193 X |

*Primary Examiner*—Richard A. Schacher

*Attorney, Agent, or Firm*—Pollock, Vande Sande & Priddy

[57] ABSTRACT

A vacuum roller assembly for feeding sheet material such as finishing paper, carton, foil and the like, wherein a resilient roller shell is provided with a plurality of suction ports for drawing the sheet material into non-slip contact with the roller assembly. A plurality of deformable slit-like openings extend into the resilient shell, with the slits being in vacuum communication with the suction ports to provide a suction network over the roller and adaptable for providing suction to only that portion of the vacuum roller in contact with the sheet material.

9 Claims, 9 Drawing Figures

VACUUM ROLLER

CROSS REFERENCE TO RELATED APPLICATIONS

The present application is a continuation-in-part of application Ser. No. 797,643 also filed by the present applicant on May 16, 1977 and now abandoned. It is respectfully requested that Ser. No. 797,643 be incorporated by reference thereto.

BACKGROUND OF THE INVENTION

The present invention generally relates to roller assemblies of the type adaptable for feeding sheet material such as paper, carton, foil and the like through a finishing plant. In particular, the present invention is directed to a novel vacuum roller assembly including a plurality of spaced suction ports formed therein, which are in fluid communication with a source of vacuum suction. The roller assembly further includes a resiliently deformable outer shell provided with a plurality of slit-like openings in fluid communication with the suction ports to provide a substantially uniform suction network over the roller surface to draw the sheet material into non-slip contact with the roller assembly.

Known vacuum roller assemblies have proven less than completely satisfactory in their inability to provide substantially uniform suction between the roller assembly and sheet material. As a result, the sheet material tends to slip relative to the rotating roller. A further disadvantage of known vacuum roller assemblies is their general inability to compensate for sheet material of varying thickness. As a result, the vacuum ports and fixed grooves formed on known roller assemblies will tend to leave undesirable tracks or markings on sheet material having a fine substratum. Because fixed grooves are employed in prior art assemblies, any dirt which may settle between the groove walls can be easily transferred to the surface of the sheet material.

As for example, U.S. Pat. No. 3,562,883 issued Feb. 16, 1971 to Koyabashi suggests a suction press roll including a plurality of fixed wall grooves extending across the roller surface into fluid communication with a plurality of separate suction ports. A vacuum is applied through the grooves to draw water from sheet material fed across the roller assembly. The fixed groove arrangement suggested in Kobayashi provides a substantially constant vacuum which may not be appropriate for sheet matter of widely varying composition. Furthermore, because of the fixed groove wall spacing suggested in Kobayashi, dirt and the like can easily accumulate within the grooves. Finally, because grooves of the type suggested in Kobayashi are generally machined into the roller body, the resulting production costs can be relatively high.

As will be discussed in detail hereafter, applicant's new and useful vacuum roller assembly solves the problems contronting prior art, while at the same time providing an inexpensive assembly wherein the deformable slit-like openings provide a variable suction force for drawing sheet material of varying thickness into non-slip contact with the foller assembly.

OBJECTS AND SUMMARY OF THE PRESENT INVENTION

An object of the present invention is to provide a vacuum roller assembly including a plurality of slit-like openings formed in an outer shell of resiliently deformable material for providing a substantially uniform suction force across the roller surface.

Another object of the present invention is to provide a vacuum roller assembly wherein the suction force is provided to only those portions of the roller surface contacting the sheet material.

A yet further object of the present invention is to provide a vacuum roller assembly wherein the level of suction force varies responsive to the specific sheet material to prevent marking of the sheet material while ensuring non-slip engagement between the roller and sheet.

Another object of the present invention is to provide a non-slip vacuum roller assembly wherein expensive machining of grooves or the like into the roller body is avoided.

Each of the above-described objects is achieved in a preferred embodiment of the present invention, wherein a hollow, steel roller body adaptable for rotation on a fixed bearing member and is surrounded by a shell of resiliently deformable material. A plurality of suction ports extend through wall portions of the roller body, with the suction ports being in fluid communication with at least one vacuum chamber formed within the bearing member. The vacuum chamber extends through a circumferential portion of the roller assembly corresponding to the circumferential distance the sheet material remains in contact with the resilient surface of the outer shell.

A plurality of slit-like openings are formed in the outer surface of the resilient shell, with the slits extending between the suction ports to form a suction network across the shell surface. Suction force applied to one end of the vacuum chamber is transferred through the suction ports to act against the sheet material. As the sheet material contacts the rotating resilient outer shell, natural tension between the sheet material and shell causes the resilient shell to deform, with adjacent slit-like openings being temporarily widened. The widened slits cooperate with the suction ports to provide a substantially non-slip engagement with the rotating roller assembly. In a similar manner, as the sheet material leaves the rotating roller, adjacent slits close to their initial shape. When sheet material with finer substratus is processed, the natural tension between the sheet material and shell is reduced. This reduced the opening of the slits with a corresponding reduction in the suction force transmitted between suction ports through the network of slits. As a result, a reduced effective suction ensures that sheet material is not drawn into such tight contact with the shell so as to transmit undesirable markings or tracks from the slits into the sheet material.

The present invention will become apparent from a reading of the following specification and claims, together with the accompanying drawings, wherein similar elements are referred to and are indicated by similar reference numerals.

BRIEF DESCRIPTION OF THE DRAWINGS

The present invention can be best understood with reference to the accompanying drawings, wherein.

DETAILED DESCRIPTION OF THE PREFERRED EMBODIMENT

Figure 1:
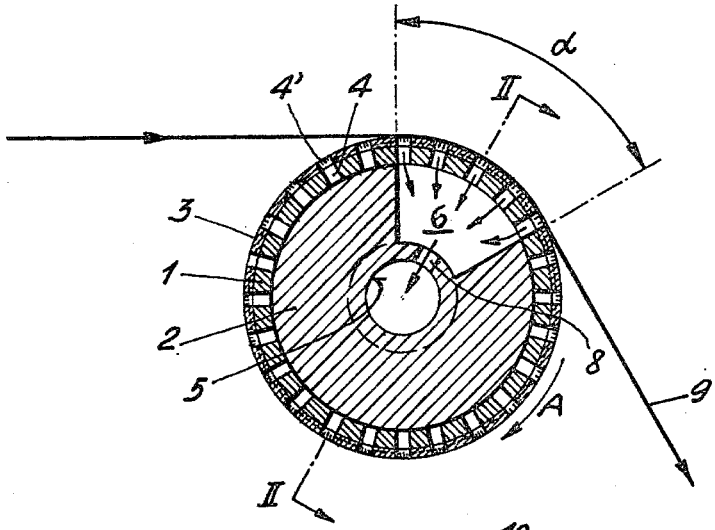
FIG. 1 shows a cross-sectional view of a preferred embodiment of the present invention as taken along line I—I of FIG. 2.
Figure 3:
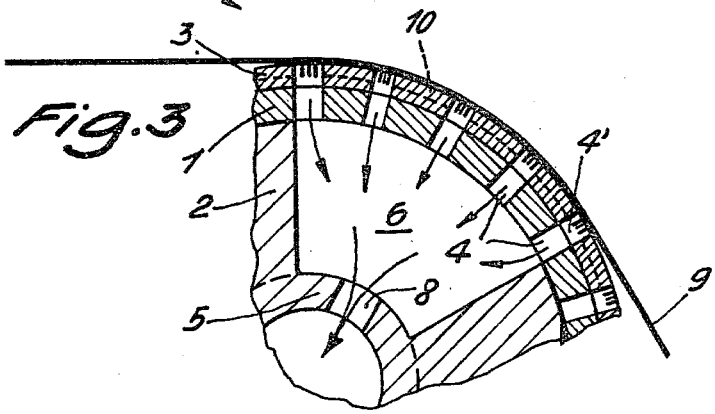
FIG. 3 shows a partial cross-sectional view similar to FIG. 1 taken on a larger scale.
Figure 2:
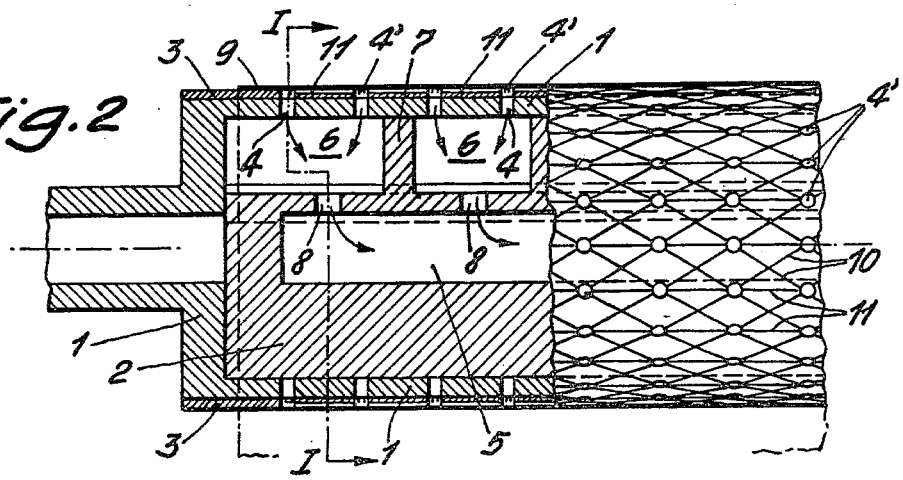
FIG. 2 shows a partial axial section view of a roller assembly formed in accordance with a preferred embodiment of the present invention as taken along line II—II of FIG. 1.

Referring to the drawings, and FIGS. 1–3 in particular, a hollow, cylindrically-shaped steel roller body is indicated at 1. Roller body 1 is rotatably supported on a fixed, cylindrically shaped bearing member 2, with a roller body 1 being driven in the direction of the arrow A in FIG. 1.

Roller body 1 is surrounded by a cylindrically shaped shell 3, which is formed of resiliently deformable material. A plurality of circumferentially spaced suction ports 4 extend substantially radially through roller body 1, while a further plurality of circumferentially spaced suction ports 4' extend substantially radially through resilient shell 3. The ports 4 and 4' may be arranged in substantially coinciding positions as shown in FIGS. 1 and 3, respectively.

Turning to FIG. 2, a plurality of separate vacuum chambers 6 are positioned side-by-side within bearing member 2. Individual chambers 6 are separated by radially extending walls 7, with each chamber 6 forming a substantially pie-shaped segment extending an angle $\alpha$ about the circumference of roller body 1.

Bearing member 2 further includes a centrally disposed, longitudinally extending suction conduit 5 which is adaptable for attachment at one end with a conventional vacuum source, not shown for purposes of clarity. A plurality of apertures 8 extend substantially radially through bearing member 2, with at least one aperture 8 joining each chamber 6 with suction conduit 5.

As sheet material 9 passes over rotating roller body 1, only those suction ports 4' located within the zone of angle $\alpha$ will actually contact sheet 9. It is for this reason that each chamber 6 has been especially constructed to extend only through angle $\alpha$. As a result, a suction force generated by the vacuum source and transmitted through suction conduit 5, aperture 8, vacuum chamber 6 and suction ports 4 and 4' will draw sheet material 9 into non-slip contact with resilient shell 3.

Suction ports 4' are interconnected via a plurality of diagonally extending slit-like openings 10 and a plurality of longitudinally extending slit-like openings 11. Each of the slits 10 and 11 extends inwardly from an outer surface of resilient shell 3.

Slits 10 and 11 may conveniently be formed by a very fine sharp razor blade extending from a lathe into contact with rotating resilient shell 3 mounted thereon.

Figure 8A:
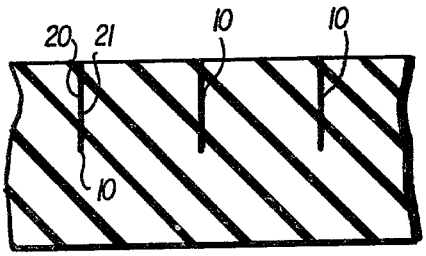
FIG. 8A shows a view of the slit-like openings formed according to the present invention.
Figure 8B:
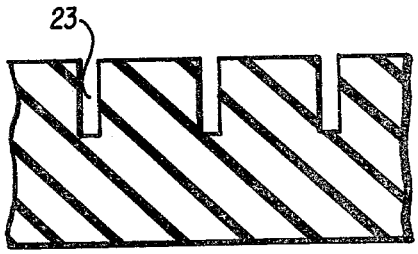
FIG. 8B shows a view of conventional, separated groove openings as presently used in the prior art.

FIG. 8A shows a plurality of typical slits 10 in an unstressed condition as would exist when not in contact with sheet 9. As noted in FIG. 8A, side walls 20 and 21 of slit 10 are in abutting contact with one another. This prevents dirt and the like from getting into the slits. In comparison, the conventionally formed grooves 23 shown in FIG. 8B have side walls 24 and 25 which are spaced from one another. As a result, the size of the groove is essentially fixed which is generally undesirable in that dirt may accumulate therebetween. Furthermore, the fixed grooves 23 may provide either too much or too little suction depending on the type of sheet material contacting the outer surface of the roller. It should be pointed out that while FIG. 8A relates to a plurality of slits 10, slits 11 are identical in shape and function; therefore, a discussion of the structure and function of slits 10 is considered sufficient for a clear understanding of slits 11.

Figure 7:
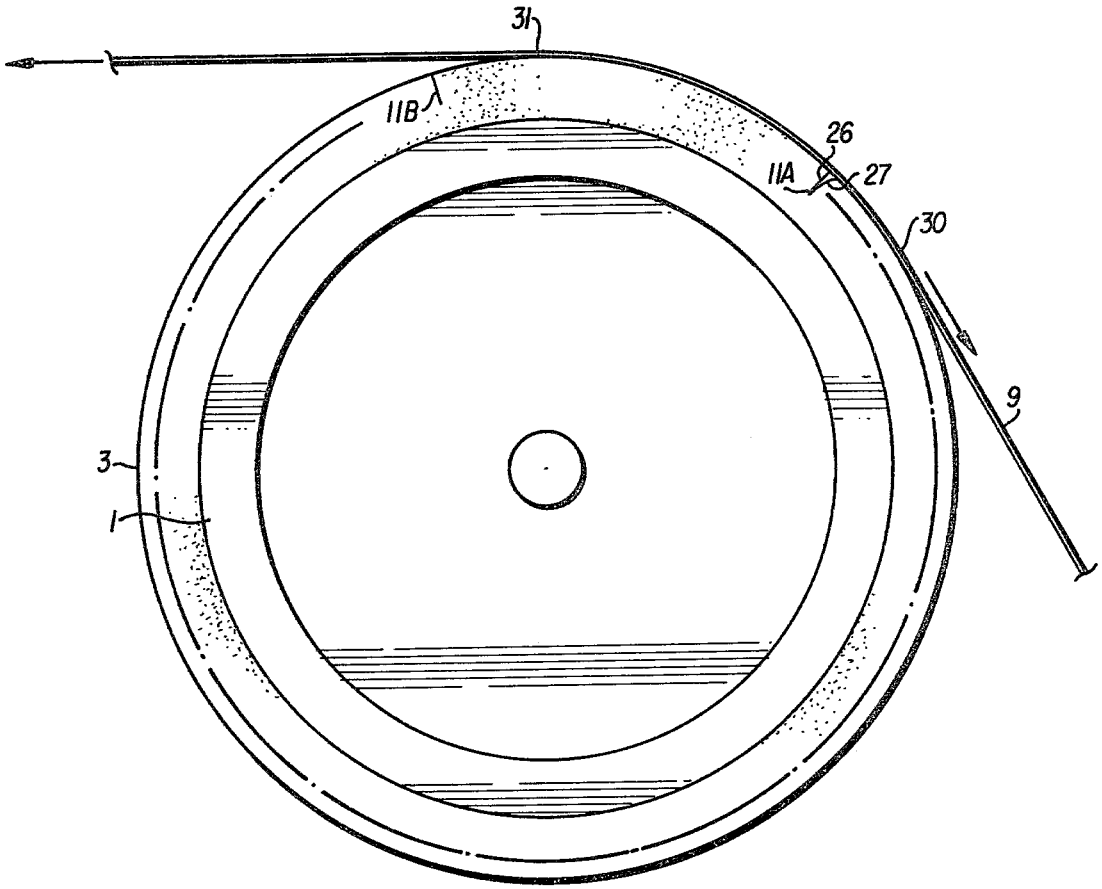
FIG. 7 shows a cross-sectional view of a roller assembly formed according to the embodiments of FIGS. 1 and 4, respectively, wherein slit-like openings are shown in both the open and closed position, respectively.

FIG. 7 shows the shape assumed by two typical slits 11A and 11B during operation of roller body 1. As sheet 9 contacts roller shell 3 at approximately point 30, the resilient material of shell 3 deforms slightly under tension, with a wall portion 27 of adjacent slit 11A being deformed away from wall portion 26. By deforming wall portion 27, slit 11 is effectively widened to transmit the suction force between spaced suction ports 4' positioned to intersect slit 11 and not shown for purposes of clarity. The distance that wall portion 27 deforms away from wall portion 26 is directly dependent on the tension created in resilient shell 3 during contact with sheet 9.

When sheets 9 of heavy substratum are processed, they tend to apply greater tension to shell 3, causing slit 11 to widen a greater distance. This, in turn provides a greater effective suction force through slit 11 for drawing sheet 9 to roller body 1 with a greater force. When sheets 9 of delicate construction, such as thin foil, are processed both the tension and the width of the slits 11 are correspondingly reduced. This provides less effective suction for drawing the sheet 9 against roller body 1 and ensures that undesirable marks are not transferred from shell 3 to the sheet material.

After the sheet material 9 has separated from roller 1 as shown approximately at 31, the deformed walls of slit 11A will return to their initial position of being in substantial abutment with one another as shown by slit 11B. Again it is noted that the explanation of the function of slits 11A and 11B is equally applicable to all of the slits 10 and 11 shown in the embodiments of FIGS. 1–6, respectively.

The network of slits 10 and 11 shown in FIGS. 1–3 extend across the entire circumferential surface of shell 3, quaranteeing even distribution of adhesion over the entire area of shell 3 in contact with sheet material 9.

Figure 4:
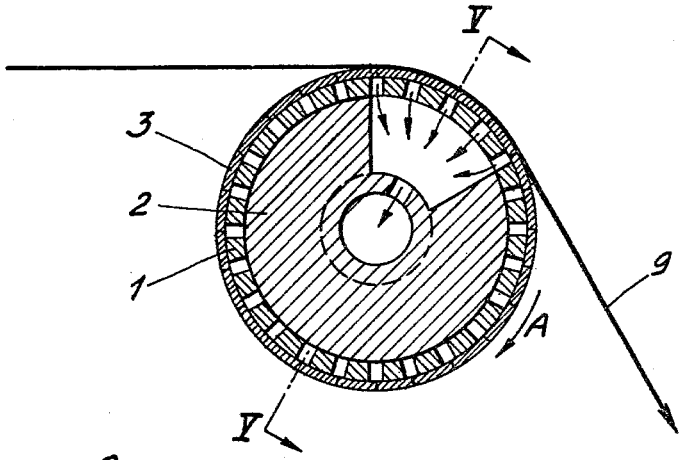
FIG. 4 shows a cross-sectional view of a further preferred embodiment of the present invention taken along line IV—IV of FIG. 5.
Figure 6:
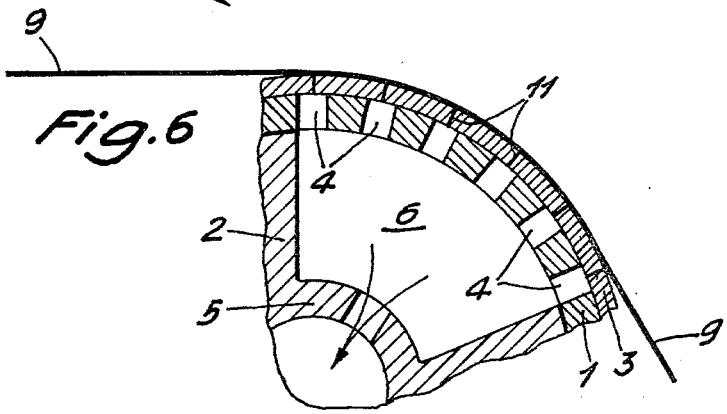
FIG. 6 shows a partial cross-sectional view similar to FIG. 4, taken on a larger scale.
Figure 5:
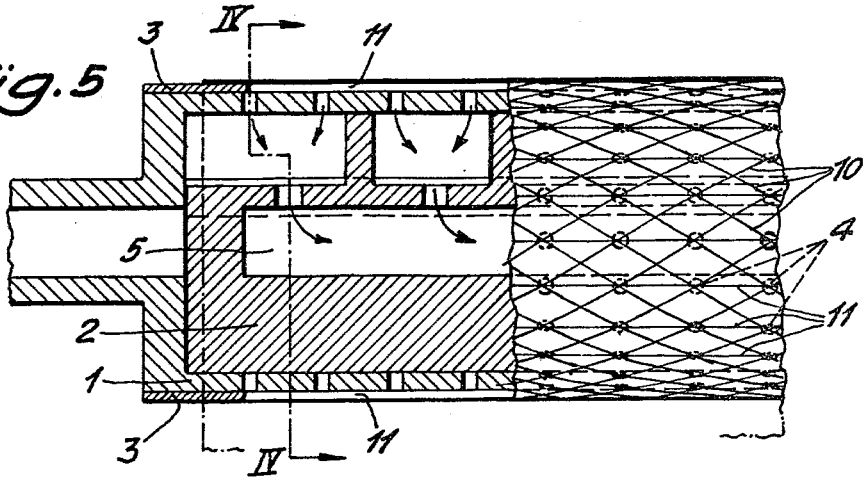
FIG. 5 shows a partial axial section of the further preferred embodiment taken along line V—V of FIG. 4.

The alternative embodiment shown in FIGS. 4–6 differs from the previously discussed embodiment, in the elimination of suction ports 4' and the extension of slits 10 and 11 completely through shell 3. The slits extend between spaced suction ports 4 and operate in a similar manner to the slits 10 and 11 discussed with reference to FIGS. 1–3, 7 and 8.

While the present invention employs longitudinally extending slits and diagonally extending slits, it is considered within the scope of the present invention to form other patterns across the roller surface. For example, longitudinal slits may be combined with circumferentially extending slits. In any case, it is the unique shape and function of the individual slits which provides the appropriate suction force for uniformly drawing the sheet into non-slip contact with the roller assembly without forming undesirable marks on confronting surfaces of the sheet material.

The present invention is not limited to the above-described embodiments, but is limited only by the scope of the following claims.

What is claimed is:

1. A rotatable vacuum roller assembly adaptable for non-slip feeding of sheet material such as paper, carton, foil and the like, said roller assembly comprising:

a rotatable, cylindrically shaped hollow roller body for supporting and feeding said sheet material;

a cylindrically-shaped shell of resiliently deformable material for enclosing said roller body, said resilient shell having an inner surface engaging an outer surface of said roller body for joint rotation of said shell and roller body about an axis extending longitudinally through said roller body;

vacuum transfer means for transmitting suction force from a vacuum source to an outer surface of said roller assembly;

a deformable slit means extending through an outer surface of said resilient shell into fluid communication with said vacuum transfer means;

said slit means including opposite slit wall portions in abutting contact with one another, with said wall portions being separable a variable distance responsive to tension generated by contact with a specific sheet material to provide a suction force across the shell surface to draw said sheet material into non-slip contact with said rotatable roller assembly.

2. A roller assembly according to claim 1, wherein said roller body is rotatably mounted on a fixed bearing member.

3. A roller assembly according to claim 2, wherein said vacuum transfer means comprises at least one pie-shaped chamber formed within said bearing member, said chamber having a curved outer surface extending adjacent to circumferential portion of roller body.

4. A roller assembly according to claim 2, wherein said vacuum transfer means comprises a plurality of pie-shaped, separate vacuum chambers longitudinally positioned within said bearing member, with radially extending bearing walls separating adjacent chambers and each chamber having a curved outer surface extending adjacent to a circumferential portion of said roller body.

5. A roller assembly according to claim 4, wherein said vacuum transfer means further comprises a conduit extending longitudinally through a centrally disposed portion of said bearing member, with at least one aperture extending between each vacuum chamber and said central conduit, said central conduit being in fluid communication with a vacuum source for transmitting suction force through said central conduit and said plurality of separate vacuum chambers.

6. A roller assembly according to claim 1, wherein said vacuum transfer means includes a plurality of apertures formed completely through said resilient shell, wherein each of said apertures coincides with a respective suction portion formed in said roller body.

7. A vacuum roller assembly according to claim 1, wherein said slit means comprises a first plurality of slit-like openings extending longitudinally across said outer shell surface and a second plurality of slit-like openings extending helically about said outer shell surface.

8. A vacuum roller assembly according to claim 7, wherein said first and second plurality of slit like openings each extend partially through said resilient shell from said outer surface.

9. A vacuum roller assembly according to claim 7, wherein said first and second plurality of slit-like openings each extend completely through said resilient shell.

* * * * *